US007563214B2

(12) United States Patent
Webber et al.

(10) Patent No.: US 7,563,214 B2
(45) Date of Patent: Jul. 21, 2009

(54) EXERCISE ARM ASSEMBLY FOR EXERCISE MACHINE

(75) Inventors: Randall T. Webber, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 1069 days.

(21) Appl. No.: 10/634,299

(22) Filed: Aug. 5, 2003

(65) Prior Publication Data

US 2004/0029688 A1 Feb. 12, 2004

Related U.S. Application Data

(63) Continuation-in-part of application No. 10/417,431, filed on Apr. 16, 2003, now Pat. No. 6,988,977, which is a continuation of application No. 09/516,093, filed on Feb. 29, 2000, now Pat. No. 6,579,213.

(51) Int. Cl.
*A63B 21/062* (2006.01)

(52) U.S. Cl. ..... 482/135; 482/100; 482/136; 482/139

(58) Field of Classification Search ..... 482/92–94, 482/97–100, 121–123, 129, 130, 133–139; D21/673, 676, 694
See application file for complete search history.

(56) References Cited

U.S. PATENT DOCUMENTS

| | | | | |
|---|---|---|---|---|
| 4,629,185 | A | 12/1986 | Amann | |
| 4,730,829 | A | 3/1988 | Carlson | |
| 4,772,015 | A | 9/1988 | Carlson et al. | |
| 4,773,398 | A | 9/1988 | Tatom | |
| 4,898,381 | A | 2/1990 | Gordon | |
| 4,949,951 | A | 8/1990 | Deola | |
| 5,039,091 | A * | 8/1991 | Johnson | 482/64 |
| 5,344,374 | A | 9/1994 | Telle | |
| D359,326 | S | 6/1995 | Deola | |
| 5,437,589 | A | 8/1995 | Habing | |
| 5,456,644 | A | 10/1995 | Hecox et al. | |
| 5,466,204 | A | 11/1995 | Nearing | |
| 5,562,577 | A | 10/1996 | Nichols, Sr. et al. | |
| 5,582,564 | A | 12/1996 | Nichols, Sr. et al. | |
| 5,597,257 | A | 1/1997 | Habing | |
| 5,597,375 | A | 1/1997 | Simonson | |

(Continued)

OTHER PUBLICATIONS

Hoist Fitness Systems CD2900 Rear Delt/Pec Fly, Brochure Jan. 2001.

(Continued)

*Primary Examiner*—Glenn Richman
(74) *Attorney, Agent, or Firm*—Procopio, Cory, Hargreaves & Savitch LLP

(57) ABSTRACT

An exercise arm assembly for mounting on an exercise machine frame has a main arm, a swing arm, and a handle. The main arm has a first end for pivoting on a frame of the machine to pivot about a first pivot axis. The swing arm has a first end pivoted to the second end of the main arm for pivoting about a second pivot axis. The handle is pivoted to the swing arm for pivoting about a third pivot axis, with each pivot axis being non-parallel to the other two pivot axes, and at least one pivot axis being non-perpendicular to the other two pivot axes.

38 Claims, 4 Drawing Sheets

U.S. PATENT DOCUMENTS

| | | | | |
|---|---|---|---|---|
| 5,643,152 | A | 7/1997 | Simonson | |
| 5,665,036 | A | 9/1997 | Hsieh | |
| 5,681,247 | A | 10/1997 | Webber | |
| 5,683,334 | A | 11/1997 | Webber | |
| 5,810,701 | A | 9/1998 | Ellis et al. | |
| 5,823,920 | A | 10/1998 | Grider | |
| 5,836,858 | A | 11/1998 | Sharff | |
| 5,916,072 | A | 6/1999 | Webber | |
| 5,967,954 | A | 10/1999 | Habing | |
| 5,971,895 | A | 10/1999 | Habing | |
| 5,997,447 | A | 12/1999 | Gianneli et al. | |
| 6,004,247 | A | 12/1999 | Webber | |
| 6,030,322 | A | 2/2000 | Webber | |
| 6,080,091 | A | 6/2000 | Habing | |
| D439,941 | S | 4/2001 | Batca et al. | |
| 6,234,941 | B1 * | 5/2001 | Chu | 482/100 |
| 6,238,323 | B1 | 5/2001 | Simonson | |
| 6,244,999 | B1 * | 6/2001 | Alessandri | 482/142 |
| 6,302,833 | B1 | 10/2001 | Ellis et al. | |
| 6,394,936 | B1 | 5/2002 | Voris | |
| 6,579,213 | B1 | 6/2003 | Webber et al. | |
| 6,592,498 | B1 * | 7/2003 | Trainor | 482/97 |
| 6,689,023 | B2 | 2/2004 | Baumler | |
| 6,988,977 | B2 | 1/2006 | Webber et al. | |
| 2006/0035764 | A1 | 2/2006 | Webber | |
| 2006/0116254 | A1 | 6/2006 | Webber | |
| 2007/0249474 | A1 | 10/2007 | Webber | |

OTHER PUBLICATIONS

Office Action of Sep. 20, 2007, U.S. Appl. No. 11/333,833 of Webber filed Jan. 17, 2006.
TuffStuff PL-202 Bilateral Vertical Chest Press, Task Industries, Jan. 1997 advertisement.
Nebula Fitness Equipment, Lever Row Swivel Adjustments #4005, catalog 1993.
TuffStuff, TUB49 Upper Body Machine, catalog, 1998.
Polaris, Upper Torso Machines, brochure, 1983, p. 2.
Hoist Fitness Systems, brochure, 1989.
Gym 80, Butterfly with Start Assistance, brochure 1994.
Icarian, Rear Delt/Pec Fly, brochure 1993.
Bodymasters, Pec Contractor Rear Deltoid Machine, date unknown, p. 11.
Cadex, Chest Press and Fly, advertisement, 1997.
Schnell, pectoral machine (Discs) brochure, date unknown.
Life Fitness Rear Deltoid/pectoral Fly, brochure, 1997.
Flex, Deltroid Fly brochure, date unknown.
Linear Stairmaster, brochure, date unknown.
Pacific Fitness, brochure, 1998.
Paramount, Rotary Chest Press, brochure, 1997.
Paramount, Rotary Chest Press, brochure, date unknown.
Corbin Pacific, Chest Press Machine, advertisement *Strength & Conditioning Association Journal*, Apr.-May 1982.
TuffStuff, Muscle IV, brochure, 1986.
Hoist Fitness Systems, CD2900 Rear Deltoid/Pectoral Fly brochure, Jan. 2001.

* cited by examiner

EXERCISE ARM ASSEMBLY FOR EXERCISE MACHINE

CROSS-REFERENCE TO RELATED APPLICATIONS

This application is a continuation-in-part of application Ser. No. 10/417,431 filed Apr. 16, 2003 now U.S. Pat. No. 6,988,977, which was a continuation of application Ser. No. 09/516,093 filed Feb. 29, 2000, now U.S. Pat. No. 6,579,213.

BACKGROUND OF THE INVENTION

The present invention relates generally to weight-lifting exercise machines, and is particularly concerned with exercise arms for such machines for use in performing upper body exercises.

Various upper body exercises are performed for exercising different upper body muscle groups, such as pectoral (pec) fly, rear deltoid, chest press, and mid row exercises.

Originally, these upper body exercises were performed using hand-held weights. For pec fly and rear deltoid exercises, independent weights known as dumbbell were held in each hand. Chest press and mid row exercises could be performed using either a barbell, where a single weight is controlled by both hands, or two separate dumbbell. In a pec fly exercise, the exerciser would lie on a bench facing upwards with a weight in each hand, arms extended out to the side, and palms facing up, with the elbows bent. The exerciser would then lift the weights to bring the dumbbell together over their body with a slight arcing or elliptical pattern to the movement. For a rear deltoid exercise, the exerciser would lie face down on a bench with a dumbbell in each hand, with their arms straight down, palms facing each other, and elbows slightly bent. Keeping the arms in the same bent position, the exerciser would lift the weights until their arms were straight out to the side.

In order to perform a chest press using dumbbell, the exerciser would lie face up on a bench with a weight in each hand, arms to each side with elbows bent and hands close to the chest. The exerciser would then push the weights up, bringing the dumbbell together over their body in a slight arcing or elliptical movement. In a mid row exercise, the exerciser would bend over at the waist with a weight in each hand, arms hanging straight down, and hands together with the palms facing each other. Staying in the bent position, the user would then pull the weights up to chest level with a slight arcing or elliptical pattern to the movement.

Various exercise machines have been designed in order to duplicate one or more of the free weight, upper body exercises such as pec fly, rear deltoid, chest press, and mid row. Typically, these machines have pivoted arms linked to an exercise resistance. There are several problems in attempting to combine two or more of the upper body exercises with a single exercise arm assembly, due to the different motions which must be accommodated for each exercise.

The earliest pec fly machine had two independent exercise arms pivotally mounted on a frame above the user's head. The arms were generally L-shaped with a pivot shaft attached to the end of one leg of the L and a pad or roller attached to the other leg. The user sat on a seat mounted on the frame with their upper arms parallel to the floor and forearms bent 90 degrees at the elbow. With their forearms resting against the pads, the user rotated their arms forward until they came together. Since the exercise arms had only one pivot, they could only move in a concentric or circular pattern, and the arms were non-adjustable for different users. In order to perform a rear deltoid exercise on this machine, a user would sit facing the rear of the machine, placing their elbows on the pads, and trying to rotate their arms rearwards. This was a cramped, uncomfortable position which did not allow a full range of motion, and was of marginal value from an exercise point of view.

In view of the limitations of the earliest pec fly machine in performing rear deltoid exercises, a separate rear deltoid machine was designed, which allowed users to fully extend their arms and perform a full range of exercise motion. This machine had a second pivot to pivotally mount a handle at the bottom of the second leg of the L-shaped arm. The handle was T-shaped, with the bottom of the T pivotally secured to the exercise arm and the grip portion of the handle comprising the top of the T and oriented vertically. This machine could also be used for pec fly exercises, and had the advantage that the user's hands were placed in a more natural position.

A combination pec fly/rear deltoid machine encounters difficulties due to the fact that the two exercise movements are different. In the rear deltoid exercise, the natural position for the arms is fairly straight with a slight bend or break at the elbows throughout the entire movement, which is circular or concentric. In a pec fly exercise, the natural movement is more elliptical, since the starting width of the exerciser's grip is closer to their body at the beginning of the exercise than at the end. In order to function properly for both exercises, the original combination machines had to have a T handle short enough to provide the necessary pre-stretch for a rear deltoid exercise. This handle was not quite long enough to provide the swing necessary for the proper elliptical arc on a pec fly exercise.

In later machines, the rotating handle was eliminated and replaced with a swing arm, which hinged at the elbow of the L-shaped exercise arm. The second pivot was perpendicular to the first pivot at the top of the exercise arm, and at the same elevation as the first pivot. Pads or handles were mounted to the swing arms to engage the user's forearms or hands.

Various machines have also been designed for performing press type exercises. U.S. Pat. No. 5,916,072 of Webber describes an exercise apparatus with an exercise arm assembly for performing chest press and mid row exercises. A pair of swing arms are pivoted at opposite sides of a U-shaped, pivoted yoke. Various alternative configurations are described, including some in which the swing arms have two pivoting sections. All the designs have parallel pivots and cannot provide a converging, pulling exercise movement. This design will not work for a combination machine with pushing/pulling converging movement.

U.S. Pat. No. 5,181,896 of Jones describes an exercise machine for performing incline press exercises which has independent, fixed arc, converging exercise arms. This can be used for only one type of exercise. U.S. Pat. No. 5,643,252 of Simonson describes independent, single piece exercise arms that travel in a fixed arc and can be used for performing chest press exercises. The handles are rigidly secured to the exercise arms.

None of the prior art exercise machines for performing upper body exercises have exercise arms which can readily duplicate the motions required for both pushing and pulling exercises, and which can adjust readily for user's arm length and desired starting pre-stretch. Additionally, the handles provided in prior art machines often have limited or no ability to adjust to the most natural hand/wrist position throughout the entire exercise movement. A number of prior art machines allow only one, fixed hand position during the entire exercise, and allow little or no adjustment of the arc of the exercise movement.

SUMMARY OF THE INVENTION

It is an object of the present invention to provide a new and improved exercise arm assembly for an exercise machine which can be used for either pushing or pulling exercises, or used on a combination machine for performing both types of exercise.

According to the present invention, an exercise arm apparatus is provided which comprises a pair of exercise arm assemblies, each arm assembly having a main arm having a first end for pivoting on a frame of an exercise machine for pivoting about a first pivot axis, a swing arm having a first end pivoted to the main arm for pivoting about a second pivot axis, and a handle pivoted to the swing arm for pivoting about a third pivot axis, each pivot axis being non-parallel to the other two pivot axes, at least two of the pivot axes also being non-perpendicular to one another.

In prior art exercise arm assemblies with multiple pivots, there were always at least two pivot axes extending parallel to one another. In the present assembly, the tri-pivot system, each pivot axis is non-parallel to both of the other pivot axes, and at least two pivot axes are not perpendicular. This provides a multi-dimensional exercise arm which can perform both concentric and eccentric exercise movements. The first pivot axis may be vertical or horizontal while the other two may extend at acute or obtuse angles to the first pivot axis. Because of this, the handles can be positioned so that they are on the inboard side of the swing arms, facing the user, at all times. This allows the handles to be completely adjustable and self-aligning during either a pec fly or rear deltoid exercise, and provides the user with an unlimited number of hand positions.

Preferably, the main arm has a downwardly angled bend, so that the swing arm hinges to the main arm below the level at which the main arm pivots to the frame. The swing arm preferably also has an angled bend, so that it angles outwardly from its pivotal connection to the main arm, and then downwardly to the handle. This allows the second pivot axis to be brought in closer to the exerciser, while still allowing the swing arm and handles to swing out wide enough to perform the various exercises correctly. The swing arms are free swinging and are not affected by the resistance, nor do they affect the resistance.

The rotation of the swing arm about the second pivot axis may be limited by a range limiting system, comprising a pin connected to one of the arms and a pair of spaced end stops on the other arm to engage the pin as the swing arm is rotated in opposite directions about the second pivot axis. The end stops may be arranged to define a first, inner end position of the swing arm in which it is positioned in a generally vertical orientation and a second, outer end position of the arm in which it is angled outwardly. The second end position is designed to restrict the outward movement of the swing arm so as to prevent contact with the machine frame.

The handle may have a pivoting grip mounted perpendicular to the third, or handle, pivot axis. The grip pivots freely about its axis and allows the user to adjust their hand/wrist position at any time during the course of an exercise without causing strain or binding to the wrist.

The combination of pivoting grip, handle and swing arm allows the user to determine their ideal exercise path, and provides self-alignment during the course of the exercise movement. As the swing arms are raised, the handles will automatically adjust to keep the user's hands in the most natural and comfortable position.

The independent, multi-pivoting exercise arms of this invention transform traditional, single plane rotary movement exercises into multi-plane elliptical movements that bring a greater number of muscle groups into play and increase their involvement for a more effective workout. The user can selectively perform single plane rotary and user defined elliptical and multi-plane movements, making the apparatus much more versatile than prior art exercise arm assemblies. The ability of the handles to adjust and self-align, providing an unlimited number of possible hand positions, is important for the comfort of the user, particularly when the apparatus is used in the medical/rehabilitation industry where certain injuries can preclude the use of a fixed hand position.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 6:
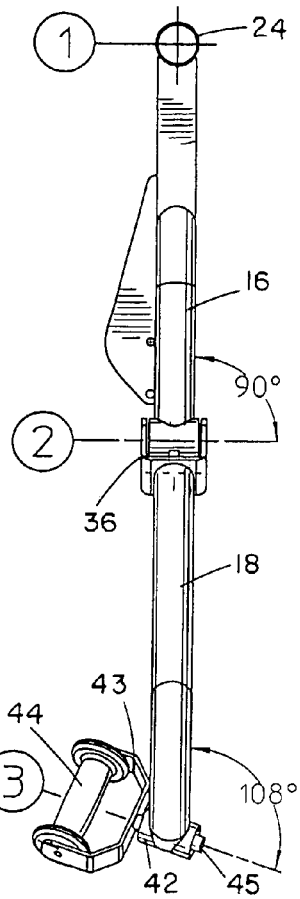
FIG. 6 is a side view of the arm assembly in the fully extended position with the handles rotated to keep the user's hands in a comfortable position.
Figure 5:
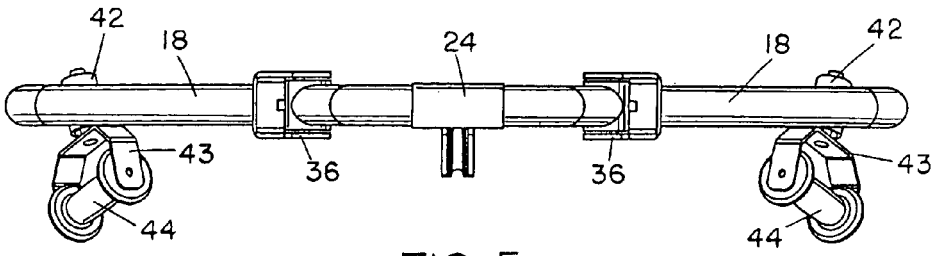
FIG. 5 is a top view of the assembly of FIG. 4, showing the arms fully extended.
Figure 7:
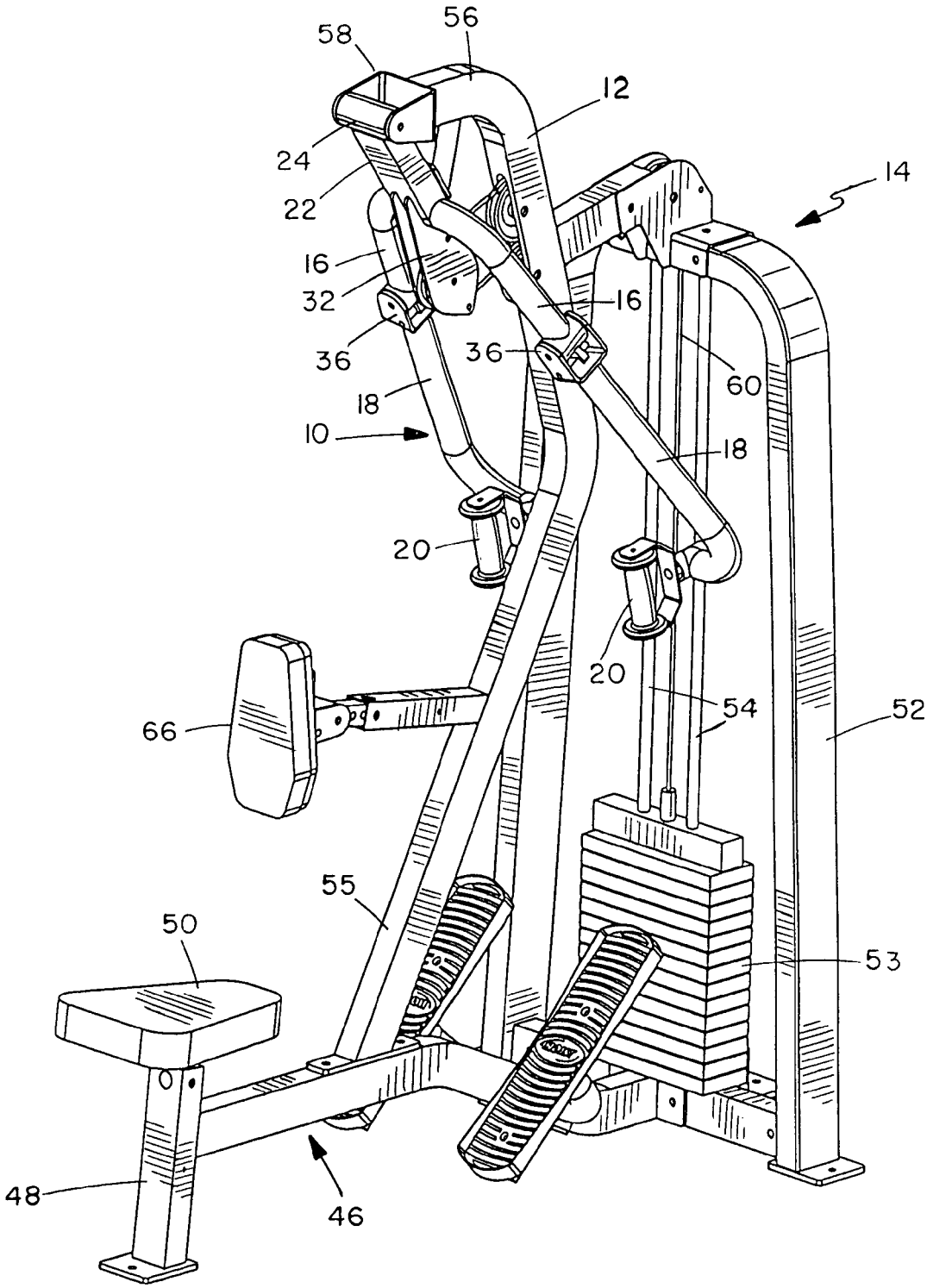
FIG. 7 is a rear perspective view of a mid row exercise machine incorporating the exercise arm assembly of FIGS. 1 to 6.

FIGS. 1 to 6 of the drawings illustrated an exercise arm apparatus 10 according to a first embodiment of the present invention. FIG. 7 illustrates apparatus 10 mounted in an overhead position on the frame 12 of an exercise machine 14. In FIG. 7, the arm assembly is arranged for performing mid-row exercises. However, it may alternatively be positioned on an exercise machine frame for performing other types of exercises, such as chest press, overhead press or pec fly exercises.

Figure 1:
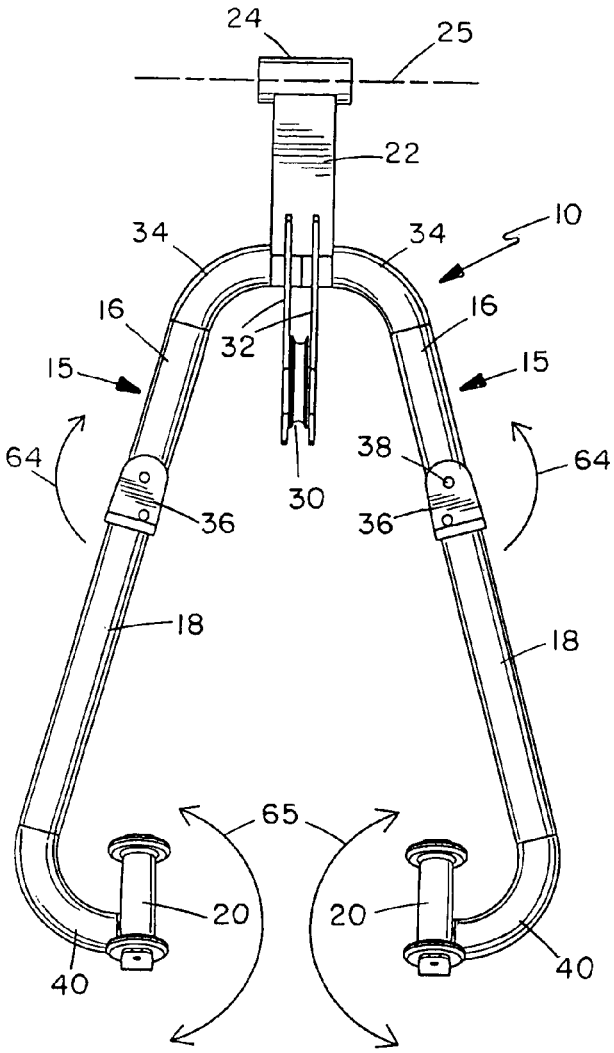
FIG. 1 is a front view of an exercise arm assembly according to a first embodiment of the invention, with the arms shown in a rest or start position.
Figure 2:
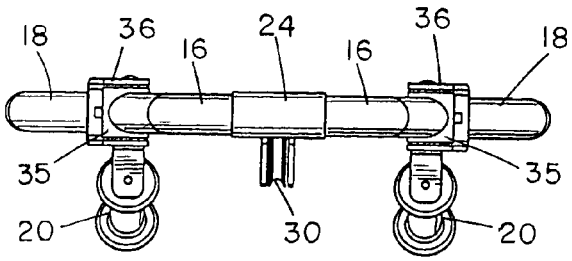
FIG. 2 is a top plan view of the assembly of FIG. 1.
Figure 3:
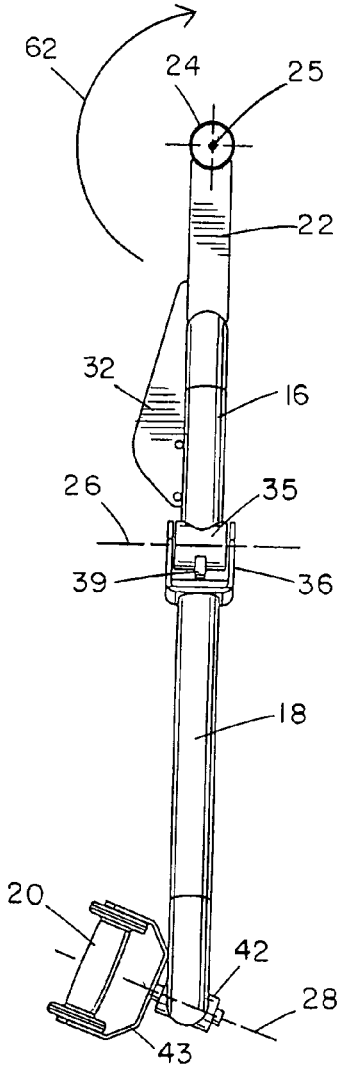
FIG. 3 is a side view of the structure of FIG. 1.
Figure 4:
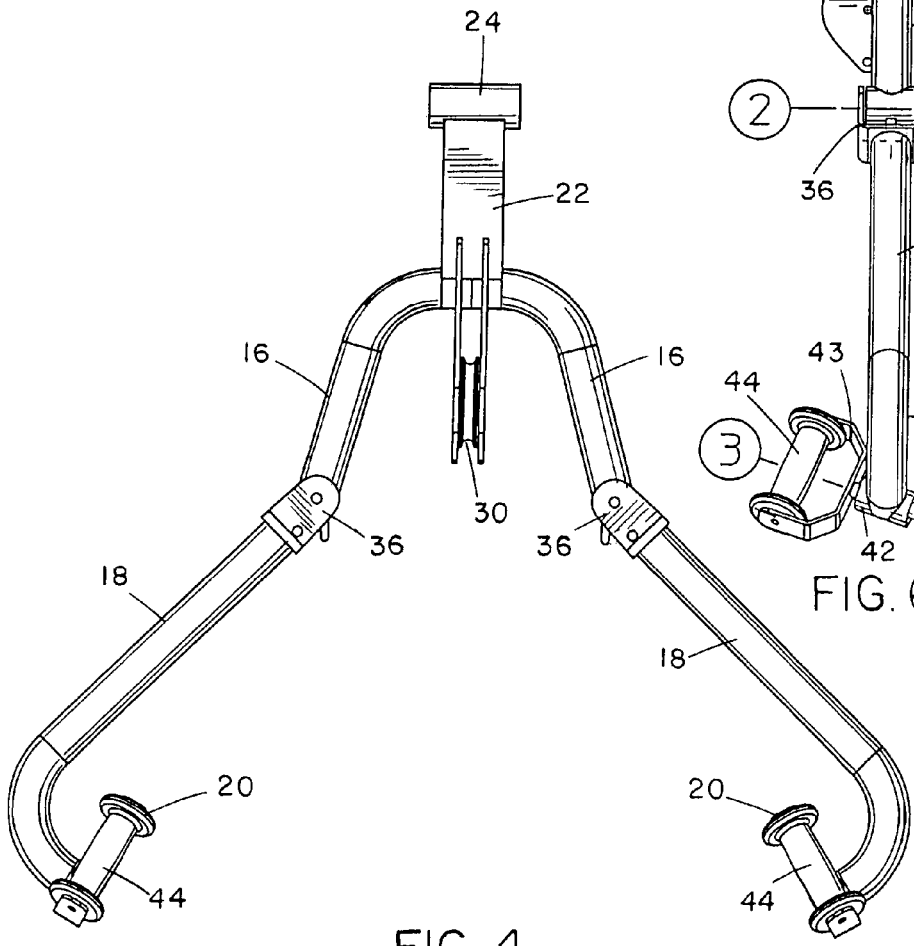
FIG. 4 is a front view similar to FIG. 1, showing the arms fully extended.

In prior application Ser. No. 09/516,093 of Webber et al., filed Feb. 29, 2000, the contents of which are incorporated herein by reference, The exercise arm apparatus of FIGS. 1 to 6 comprises a pair of arm assemblies 15 each having a main arm 16, a swing arm 18, and a handle 20. The main arms 16 are secured together at their first ends, or may comprise one integrally formed, U-shaped arm member or yoke, with a pivot arm 22 extending from the central portion or connected ends of the main arms and having a pivot sleeve 24 defining a first pivot axis 25 for the main arms. Each swing arm 18 has a first end pivoted to the second end of the respective main arm 16 for pivoting about a second pivot axis 26 which is not coaxial with the swing arm 18, as can be seen in FIG. 3. Each handle 20 is pivoted to the second end of the respective swing arm 18 for pivoting about a third pivot axis 28. Unlike the prior application referenced above, in this case the three pivot axes are not all perpendicular. In this case, the first and second pivot axes 25, 26 are perpendicular, as indicated in FIG. 6. However, the third pivot axis 28 is askew, extending at a non perpendicular angle to the swing arm center line, and is therefore also not perpendicular to either of the other two pivot axes. Pivot axis 25 is the main pivot which controls forward/rearward movement of the exercise arm assembly, while pivot axis 26 controls outward/inward movement of the swing arms, and pivot axis 28 controls rotational orientation of the handles. In this arrangement, no two pivot axes are parallel, and at least one pivot axis is non-perpendicular to the other two pivot axes. The non-parallel, non-perpendicular handle pivot axis allows for different orientations of the user's hand during the exercise movement.

The exercise arm apparatus of FIGS. 1 to 6 comprises a pair of arm assemblies 15 each having a main arm 16, a swing arm 18, and a handle 20. The main arms 16 are secured together at their first ends, or may comprise one integrally formed, U-shaped arm member or yoke, with a pivot arm 22 extending from the central portion or connected ends of the main arms and having a pivot sleeve 24 defining a first pivot axis 25 for the main arms. Each swing arm 18 has a first end pivoted to the second end of the respective main arm 16 for pivoting about a second pivot axis 26. Each handle 20 is pivoted to the second end of the respective swing arm 18 for pivoting about a third pivot axis 28. Unlike the prior application referenced above, in this case the three pivot axes are not all perpendicular. In this case, the first and second pivot axes 25,26 are perpendicular, as indicated in FIG. 6. However, the third pivot axis 28 is askew, extending at a non perpendicular angle to the swing arm center line, and is therefore also not perpendicular to either of the other two pivot axes. Pivot axis 25 is the main pivot which controls forward/rearward movement of the exercise arm assembly, while pivot axis 26 controls outward/inward movement of the swing arms, and pivot axis 28 controls rotational orientation of the handles. In this arrangement, no two pivot axes are parallel, and at least one pivot axis is non-perpendicular to the other two pivot axes. The non-parallel, non-perpendicular handle pivot axis allows for different orientations of the user's hand during the exercise movement.

A pulley 30 is secured to the central portion of the main arms 16 via pulley mounting brackets 32, for linking the exercise arm apparatus to an exercise resistance, for example in the manner illustrated in FIG. 7, as will be described below in more detail. Each main arm or main arm side portion 16 has a first bend 34 directing the arm generally downwardly and outwardly towards the junction with the swing arm 18. A pivot sleeve 35 is welded at the end of arm 16, and a U-shaped pivot bracket 36 at the corresponding end of the respective swing arm extends over opposite ends of sleeve 35, with a pivot pin 38 extending between the opposite ends of the pivot bracket and through sleeve 35 to allow pivoting of the swing arm about pivot axis 26. A range limiting device 39 identical to that described in U.S. patent application Ser. No. 09/516,093 referred to above is provided for limiting the range of outward and inward rotation of the swing arm between the start position illustrated in FIG. 1 and the fully extended position of FIG. 4.

Each swing arm has a bend 40 adjacent its second end for directing the end portion of the swing arm inwardly for attachment to the respective handle. A pivot sleeve 42 is welded to the end of each swing arm at a non-perpendicular orientation or skewed angle relative to the axis of the swing arm, as best illustrated in FIGS. 3 and 6. As indicated in FIG. 6, the pivot axis 28 defined by pivot sleeve 42 is at an angle of around 108 degrees to the side centerline or axis of the exercise arm. Each handle 20 has a generally C-shaped yoke or bracket 43, with a hand grip 44 rotatably mounted between the opposing ends of the bracket, and a pivot pin 45 extending from a central portion of the bracket 43 away from the hand grip. The pivot pin 45 is rotatably mounted in sleeve 42.

The exercise arm apparatus 10 may be mounted on the frame of an exercise machine in any suitable manner, either suspended from an overhead strut, or secured to an upright strut, or to the base of the frame with the arms directed generally upwardly. FIG. 7 illustrates one possible arrangement in which the apparatus 10 is mounted on a mid row machine 14. The frame 12 of the machine has a base 46 with a rear upright 48 on which a seat pad 50 is secured, and an upright weight stack guide frame 52 at the forward end of the base. A conventional weight stack 53 is slidably mounted on guide rods 54 in frame 52. Upright strut 55 extends upwardly from the base and has an upper, rearwardly directed portion 56 with a pivot mounting bracket 58 at its end on which the pivot sleeve 24 of the exercise arm apparatus is rotatably mounted. The exercise arm assembly 10 is therefore suspended from the end of overhead strut portion 56. Pulley 30 is linked to the weight stack 53 via a cable 60 extending from the weight stack around various pulleys mounted on the frame as well as pulley 30. Thus, front and back rotation of the arm assembly about the first or main pivot axis 25, in the direction of the arrow 62 in FIG. 3, is resisted by the selected weight in weight stack 53. At the same time, the user can adjust their arm position and their hand position while performing the exercise, by rotating the swing arms in and out about axis 26, in the direction of the arrows 64 in FIG. 1, and by rotating the handle about axis 28, in the direction of arrows 65 in FIG. 1.

The machine of FIG. 7 is designed to work the muscles of the upper back, also known as a mid row exercise. To perform the exercise, the user sits on the seat pad facing the machine and places their chest against chest pad 66. Stretching their arms forward, they grab the handles 20 and pull the exercise arm forward, towards their chest, rotating the apparatus about the first pivot axis 25. The second or swing arm pivot 26 allows the user to vary the spacing between their hands during the exercise motion. The user can choose between a narrow straight line pull, with the handles positioned at the spacing shown in FIG. 1, a wide straight line pull, with the handles spaced apart at their maximum spacing, as in FIG. 4, or a diverging narrow to wide pull during the front to rear movement of the arm apparatus. The third, skew pivot axis of the handles allows the user to change the angular orientation of their wrist during the exercise motion, for more comfort, and to adjust to the changing handle separation or swing arm widths if the swing arms are swung out during the front to rear pulling motion.

Figure 8:
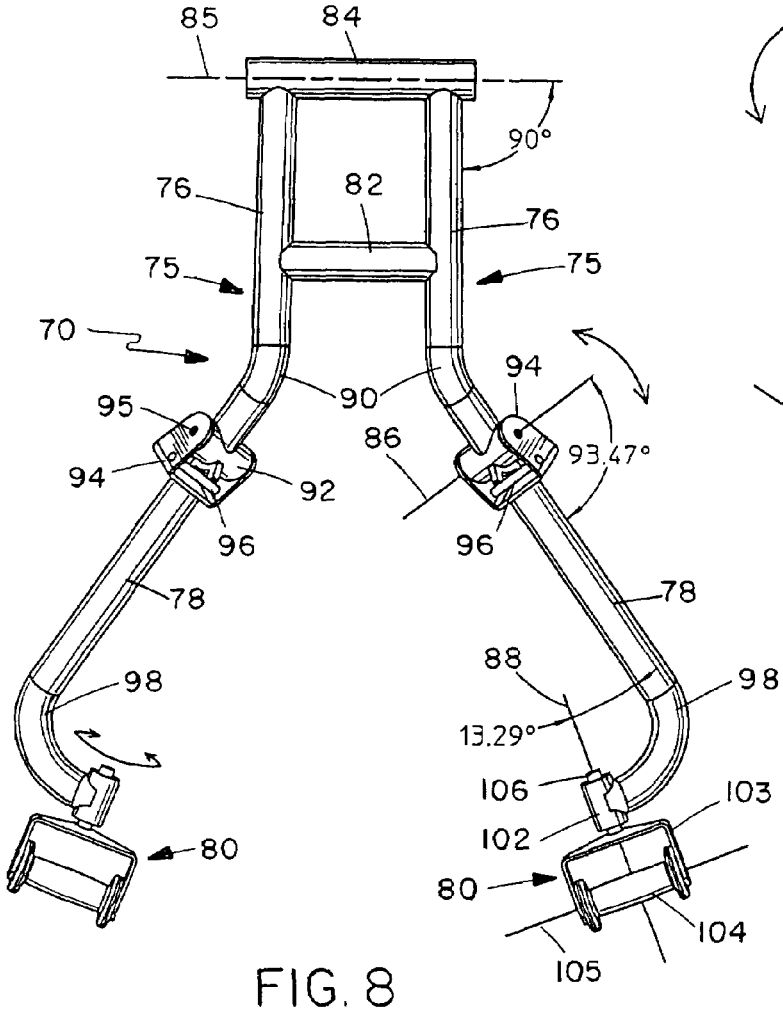
FIG. 8 is a front view of an exercise arm assembly according to another embodiment of the invention, with the arms in the starting or rest position.
Figure 10:
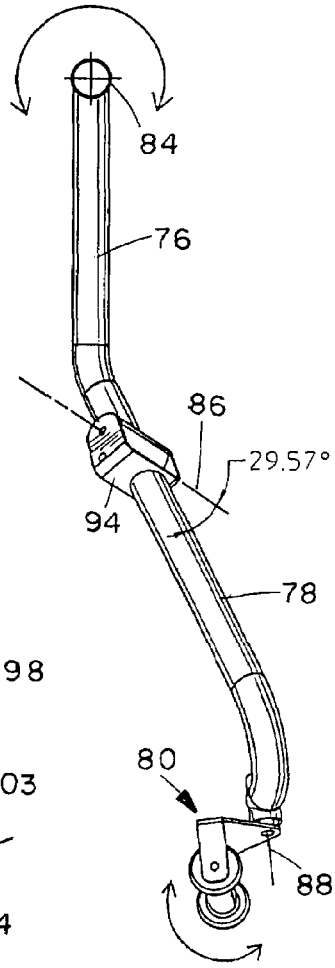
FIG. 10 is a side elevation view of the assembly of FIG. 8.
Figure 9:
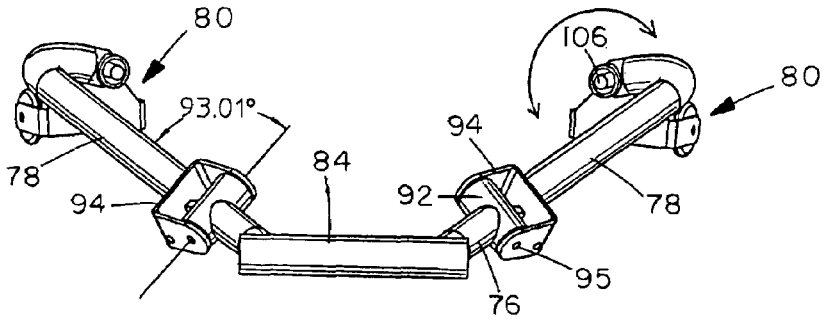
FIG. 9 is a top plan view of the assembly of FIG. 8.

FIGS. 8 to 10 illustrate a modified exercise arm apparatus 70 with three non-parallel pivot axes. In this case, no two pivot axes are perpendicular, and each pivot axis is askew to the other two. The exercise arm apparatus 70 comprises a pair of arm assemblies 75 each having a main arm 76, a swing arm 78, and a handle 80. The main arms 76 are secured together at their first ends, or may comprise one integrally formed, U-shaped arm member or yoke. In this case, the arms 76 are secured together by a first cross bar 82 spaced from their first ends, and by a pivot sleeve 84 extending across their first ends and defining a first or main pivot axis 85. Each swing arm 78 has a first end pivoted to the second end of the respective main arm 76 for pivoting about a second pivot axis 86. Each handle 80 is pivoted to the second end of the respective swing arm 78 for pivoting about a third pivot axis 88.

As noted above, in this embodiment no two pivot axes are perpendicular. As illustrated in FIG. 8, the first or main pivot axis 85 is generally horizontal and in the plane of the page. The second pivot axis 86, in addition to being non-perpendicular to the pivot axis 85, is also skewed at an angle to the plane of the paper or the plane in which the main arms 76 lie, as indicated in FIGS. 8 and 10. The third or handle pivot axis 88 is also not perpendicular to the other two, and is askew such that it does not lie in the same plane as the main arm and main pivot axis or the swing arm and second pivot axis. As in the previous embodiment, pivot axis 85 is the main pivot which controls forward/rearward movement of the exercise arm assembly, while pivot axis 86 controls outward/inward movement of the swing arms, and pivot axis 88 controls rotational orientation of the handles. In this arrangement, no two pivot axes are parallel or perpendicular to each other. The non-parallel, non-perpendicular handle pivot axis allows for different orientations of the user's hand during the exercise movement.

The exercise arm apparatus 80 may be mounted on an exercise machine frame in exactly the same way as the apparatus 10 as illustrated in FIG. 7, or in other positions for performing different types of pushing or pulling exercises. Each main arm 76 has a first bend 90 directing the arm generally downwardly and outwardly towards the junction with the swing arm 78. A pivot sleeve 92 is welded at the end of arm 76, and a U-shaped pivot bracket 94 at the corresponding end of the respective swing arm extends over opposite ends of sleeve 92, with a pivot pin 95 extending between the opposite ends of the pivot bracket and through sleeve 92 to allow pivoting of the swing arm about pivot axis 86. As best illustrated in FIG. 8 and 9, the pivot sleeve 92 is welded at a non-perpendicular, skewed orientation relative to the axis of the second or bent end portion of the respective main arm, such that it defines a pivot axis which is askew and non-perpendicular to the main pivot axis 85. A range limiting device 96 identical to that described in U.S. patent application Ser. No. 09/516,093 referred to above is provided for limiting the range of outward and inward rotation of the swing arm between the start position illustrated in FIG. 1 and the fully extended position of FIG. 4.

Each swing arm has a bend 98 adjacent its second end for directing the end portion of the swing arm inwardly for attachment to the respective handle. A pivot sleeve 102 is welded to the end of each swing arm at a non-perpendicular orientation or skewed angle relative to the axis of the swing arm, as best illustrated in FIG. 8. As indicated in FIG. 8, the pivot axis 88 defined by pivot sleeve 102 is at an angle of around 13.29 degrees to the axis of the swing arm. Each handle 80 has a generally C-shaped yoke or bracket 103, with a hand grip 104 rotatably mounted between the opposing ends of the bracket for rotation about a pivot axis 105 and a pivot pin 106 extending from a central portion of the bracket 103 away from the hand grip. The pivot pin 106 is rotatably mounted in sleeve 102. The hand grip 104 may also be rotatable about its central axis for added comfort of the user.

The exercise arm assembly of this invention overcomes a number of problems of previous pivoted exercise arms. The apparatus works equally well for both pushing and pulling exercises, and is designed to adjust automatically to the user's arm length and desired starting pre-stretch. It also has the ability to self-align during the course of an exercise movement for both the movement arc and the hand/wrist position, and the self-alignment takes place without affecting or being affected by the resistance load.

By dividing each exercise arm into three separate sections which are pivoted together by non-parallel pivots, with one or all pivot axes being non-perpendicular to the other two, the handles can be positioned at a comfortable gripping angle for the user at all times. Additionally, because the swing arm pivots below the level of the main arm pivot to the frame, and the angled bends are arranged to continue the swing arm outward and downward past the pivot connection, the swing arm hinge point can be brought in closer to the user, while still allowing the swing arm to swing out wide enough to perform the various exercises properly. The lowered hinge point, and outward angle of the swing arm, allows a greater increase in handle elevation at the outermost point of the swing. The swing arms are free swinging, and neither affect nor are affected by the resistance.

The pivoting handles have handgrips inboard of the swing arms and closer to the machine centerline, and thus the user, than the swing arms. The range limiting system on the swing arm hinge keeps the swing arm in a generally vertical orientation in the rest position. Overall, the arrangement allows the user to position their wrist at a position which is more comfortable and reduces the mechanical disadvantages for a smaller user with shorter arms. The pivoting handles with rotating grips inward of the swing arms allow for wrist and forearm pronation/supination (rotational movement). This provides multiple possible hand orientations, at any position between horizontal and vertical.

The exercise arms of this invention allow the user to perform either single plane rotary or multi-plane, user-defined elliptical movements which bring a greater number of muscle groups into play and provide a more effective workout. This transforms traditional, fixed arc, linear exercise movement patterns into user-defined, multiple converging/diverging exercise movement patterns.

Although some preferred embodiments of the invention have been described above by way of example only, it will be understood by those skilled in the field that modifications may be made to the disclosed embodiments without departing from the scope of the invention, which is defined by the appended claims.

We claim:

1. An exercise arm assembly, comprising:

a main arm having a first end for pivoting on a frame of an exercise machine for pivoting about a first pivot axis;

a swing arm having a first end and a second end;

a pivot connection between the swing arm and the main arm which defines a second pivot axis which is not coaxial with the swing arm and which allows free pivoting of the swing arm about the second pivot axis within a predetermined angular range, the swing arm being freely pivotable about the second pivot axis within the predetermined angular range during an exercise, whereby a user can define the motion of the swing arm; and a handle pivoted to the swing arm for pivoting about a third pivot axis, each pivot axis being non-parallel to the other two pivot axes, and at least one pivot axis being non-perpendicular to the other two pivot axes.

2. An exercise arm assembly, comprising:

a main arm having a first pivot connection for connection to a frame of an exercise machine, the pivot connection defining a first pivot axis;

a swing arm pivoted to the main arm for pivoting about a second pivot axis which is not coaxial with the swing arm;

a handle pivoted to the swing arm for pivoting about a third pivot axis, each pivot axis being non-parallel to the other two pivot axes, and at least one pivot axis being non-perpendicular to the other two pivot axes; and the main arm having a first angled bend defining a first portion extending from the first pivot connection to the bend and a second portion extending from the bend to the swing arm pivot axis, and the swing arm having a second angled bend defining a third portion extending from the swing arm pivot axis to the second bend and a fourth portion extending from the second bend.

3. An exercise arm assembly, comprising:

a main arm having a first pivot connection for connection to a frame of an exercise machine, the pivot connection defining a first pivot axis;

a swing arm pivoted to the main arm for pivoting about a second pivot axis;

a handle pivoted to the swing arm for pivoting about a third pivot axis, each pivot axis being non-parallel to the other two pivot axes, and at least one pivot axis being non-perpendicular to the other two pivot axes;

the main arm having a first angled bend defining a first portion extending from the first pivot connection to the bend and a second portion extending from the bend to the swing arm pivot axis, and the swing arm having a second angled bend defining a third portion extending from the swing arm pivot axis to the second bend and a fourth portion extending from the second bend; and the swing arm having a third, inward bend adjacent the handle defining a fifth portion extending inwardly from the third bend to the handle.

4. The assembly as claimed in claim 1, wherein the pivot connection includes a range limiting device which limits the free rotation of the swing arm about the second pivot axis to the predetermined angular range.

5. The assembly as claimed in claim 1, wherein the handle comprises a pivot bracket having a pivot shaft rotatably secured to the swing arm for rotation about said third pivot axis, and a grip rotatably mounted on the bracket for rotation about a fourth axis perpendicular to the third pivot axis.

6. The assembly as claimed in claim 5, wherein the grip is offset from the third pivot axis.

7. The assembly as claimed in claim 5, further comprising a pivot sleeve secured to the swing arm, said pivot shaft being rotatably secured in said pivot sleeve, and said pivot sleeve being oriented at a non-perpendicular angle to said swing arm.

8. An exercise arm assembly, comprising:

a main arm having a first pivot connection for connection to a frame of an exercise machine, the pivot connection defining a first pivot axis;

a swing arm pivoted to the main arm for pivoting about a second pivot axis;

a handle pivoted to the swing arm for pivoting about a third pivot axis, each pivot axis being non-parallel to the other two pivot axes, and at least one pivot axis being non-perpendicular to the other two pivot axes;

the main arm having a first angled bend defining a first portion extending from the first pivot connection to the bend and a second portion extending from the bend to the swing arm pivot axis, and the swing arm having a second angled bend defining a third portion extending from the swing arm pivot axis to the second bend and a fourth portion extending from the second bend;

the pivot connection between the swing arm and main arm including a range limiting device which limits free rotation of the swing arm about the second pivot axis to a predetermined angular range; and the pivot connection comprises a pivot sleeve on one of the arms, a pivot bracket on the other arm, and a pivot pin extending through the bracket and sleeve to rotatably secure the bracket to the sleeve.

9. The assembly as claimed in claim 8, wherein the main arm and swing arm each have a central axis extending up to said pivot connection, and said pivot sleeve is secured to said one arm at a non-perpendicular orientation to the central axis of said one arm.

10. The assembly as claimed in claim 8, wherein the range limiting device comprises a limiter member on the sleeve having a slot defining said angular range, and a pin mounted on the bracket for engagement in the slot.

11. An exercise arm assembly, comprising:

a main arm having a first pivot connection for connection to a frame of an exercise machine, the first pivot connection defining a first pivot axis;

a swing arm pivoted to the main arm for pivoting about a second pivot axis which is not coaxial with the swing arm;

a handle pivoted to the swing arm for pivoting about a third pivot axis, each pivot axis being non-parallel to the other two pivot axes, and at least one pivot axis being non-perpendicular to the other two pivot axes;

the handle comprising a pivot bracket having a pivot shaft rotatably secured to the swing arm for rotation about said third pivot axis, and a grip rotatably mounted on the bracket for rotation about a fourth axis perpendicular to the third pivot axis; and the grip extends transverse to the third pivot axis and is not offset from the handle pivot shaft.

12. An exercise arm apparatus, comprising:

a pair of exercise arm assemblies;

each arm assembly having a main arm, a swing arm, and a handle;

each main arm having a first location for pivoting on a frame of an exercise machine for pivoting about a first pivot axis;

a pivot connection between each swing arm and the respective main arm which allows free pivoting motion of the swing arm in a predetermined angular range about a second pivot axis which is not coaxial with the swing arm, the swing arm being freely rotatable about the second pivot axis within the predetermined angular range during an exercise;

each handle being pivoted to the respective swing arm at a location spaced from the pivot connection for pivoting about a third pivot axis, each pivot axis being non-parallel to the other two pivot axes, and at least one pivot axis being non-perpendicular to the other two pivot axes.

13. The assembly as claimed in claim 12, wherein each swing arm has an inboard side facing the other swing arm and an outboard side, and each handle is pivoted at the inboard side of the respective swing arm.

14. The apparatus as claimed in claim 12, including a pivot sleeve extending between the first locations of the main arms, and a pivot shaft rotatably mounted in the pivot sleeve for securing at a selected location on an exercise machine frame.

15. The apparatus as claimed in claim 12, wherein at least a first portion of the main arm and the first pivot axis define a first plane perpendicular to the first pivot axis, and the swing arm is pivoted to the main arm at a location askew from the first plane.

16. The apparatus as claimed in claim 12, wherein each handle comprises a handle bracket having a pivot shaft rotatably secured to the swing arm for rotation about said third pivot axis, and a grip rotatably mounted on the bracket for rotation about a fourth axis perpendicular to the third pivot axis.

17. The apparatus as claimed in claim 16, wherein the grip is offset from the third pivot axis.

18. The apparatus as claimed in claim 16, wherein each grip has opposite ends, each end of the grip having projecting annular guards for preventing contact between the user's hands when holding the grips on each arm assembly.

19. The apparatus as claimed in claim 16, wherein each handle bracket is generally c-shaped and has opposite, parallel arms, the grip having a longitudinal axis and being rotatably mounted between the arms of the handle bracket for rotation about said longitudinal axis.

20. The apparatus as claimed in claim 19, wherein each arm of the handle bracket has an outwardly projecting bumper aligned with the axis of said grip.

21. The apparatus as claimed in claim 12, wherein each pivot axis is non-perpendicular to the other two pivot axes.

22. The apparatus as claimed in claim 12, wherein the first locations of the main arms are secured together for securing at a selected location on an exercise machine frame by a single pivot connection.

23. An exercise arm apparatus, comprising:

a pair of exercise arm assemblies;

each arm assembly having a main arm, a swing arm, and a handle;

each main arm having a first pivot connection for pivoting on a frame of an exercise machine for pivoting about a first pivot axis;

each swing arm having a second pivot connection which is pivotally connected to the respective main arm for pivoting about a second pivot axis which is not coaxial with the swing arm;

each handle being pivoted to the respective swing arm for pivoting about a third pivot axis, each pivot axis being non-parallel to the other two pivot axes, and at least one pivot axis being non-perpendicular to the other two pivot axes; and the main and swing arms of each arm assembly each have at least one bend separating the arm into two relatively angled portions with the second pivot axis located between the two bends.

24. The apparatus as claimed in claim 23, wherein the exercise arm assemblies define a central axis of the exercise apparatus, each swing arm has an inboard side facing said central axis and an outboard side, and the handle is pivoted at the inboard side of the swing arm.

25. An exercise arm apparatus, comprising:

a pair of exercise arm assemblies;

each arm assembly having a main arm, a swing arm, and a handle;

each main arm having a first location for pivoting on a frame of an exercise machine for pivoting about a first pivot axis;

a pivot connection between each swing arm and the respective main arm which allows free pivoting motion of the swing arm in a predetermined angular range about a second pivot axis which is not coaxial with the swing arm;

each handle being pivoted to the respective swing arm at a location spaced from the pivot connection for pivoting about a third pivot axis, each pivot axis being non-parallel to the other two pivot axes, and at least one pivot axis being non-perpendicular to the other two pivot axes; and the pivot connection between each swing arm and the respective main arm including a range limiting device which limits the free swinging movement of the swing arm about the second pivot axis to the predetermined angular range between an inner position and an outer position.

26. The apparatus as claimed in claim 25, wherein the inner position comprises a rest position.

27. The apparatus as claimed in claim 26, wherein the swing arms are angled outwardly in said rest position.

28. An exercise arm apparatus, comprising:

a pair of exercise arm assemblies;

each arm assembly having a main arm, a swing arm, and a handle;

each main arm having a first location for pivoting on a frame of an exercise machine for pivoting about a first pivot axis;

a pivot connection between each swing arm and the respective main arm which allows free pivoting motion of the swing arm in a predetermined angular range about a second pivot axis;

each handle being pivoted to the respective swing arm at a location spaced from the pivot connection for pivoting about a third pivot axis, each pivot axis being non-parallel to the other two pivot axes, and at least one pivot axis being non-perpendicular to the other two pivot axes;

the pivot connection between each swing arm and the respective main arm including a range limiting device which limits the free swinging movement of the swing arm about the second pivot axis to the predetermined angular range between an inner position and an outer position; and the pivot connection comprising a pivot sleeve on one of the arms, a pivot bracket on the other arm, and a pivot pin extending through the bracket and sleeve to rotatably secure the bracket to the sleeve.

29. The apparatus as claimed in claim 28, wherein the range limiting device comprises a limiter member on the sleeve having a slot defining said angular range, and a pin mounted on the bracket for engagement in the slot.

30. An exercise arm apparatus, comprising:

a pair of exercise arm assemblies;

each arm assembly having a main arm, a swing arm, and a handle;

each main arm having a first location for pivoting on a frame of an exercise machine for pivoting about a first pivot axis;

a pivot connection between each swing arm and the respective main arm which allows free pivoting motion of the swing arm in a predetermined angular range about a second pivot axis which is not coaxial with the swing arm;

each handle being pivoted to the respective swing arm at a location spaced from the pivot connection for pivoting about a third pivot axis, each pivot axis being non-parallel to the other two pivot axes, and at least one pivot axis being non-perpendicular to the other two pivot axes each handle comprising a handle bracket having a pivot shaft rotatably secured to the swing arm for rotation about said third pivot axis, and a grip which is engaged by the user's hand during an exercise and which is rotatably mounted on the bracket for rotation about a fourth axis perpendicular to the third pivot axis; and the grip extending transverse to the third pivot axis and coplanar with said third pivot axis.

31. An exercise machine, comprising:

a support frame having a base, an upright portion extending upwardly from the base and having an upper end, and an upper support extending transversely from the upper end of the upright portion;

a seat supported on the frame;

a pair of exercise arm assemblies pivotally secured to the frame to extend on opposite sides of said seat;

each arm assembly having a main arm, a swing arm, and a handle;

each main arm having a first end pivoted to the frame for pivoting about a first pivot axis and a second end;

each swing arm having a pivot connection to the respective main arm which allows pivoting of the swing arm relative to the main arm about a second pivot axis;

each handle being pivoted to the respective swing arm for pivoting about a third pivot axis, each pivot axis being non-parallel to the other two pivot axes, and at least one pivot axis being non-perpendicular to the other two pivot axes;

the main arms being pivoted to the upper support and the swing arms depending downwardly from the upper support, each swing arm being pivoted to the respective main arm at a location spaced below the first end of the main arm; and each main arm having a first downward bend separating the main arm into a first portion extending from the first end to the first bend and a second portion inclined downwardly from the first portion, and the swing arm having a second bend separating the swing arm into a first portion extending from the main arm to the second bend in a direction which is not coaxial with the second pivot axis, and a second portion directed inwardly from the second bend towards the other swing arm.

32. The machine according to claim 31, including a pivot connection in each arm assembly between the main arm and swing arm defining the second pivot axis, the pivot connection including a range limiting device for limiting the swing of the swing arm about the second pivot axis to a predetermined angular range between an inner, rest position and an outer position.

33. The machine as claimed in claim 32, wherein each handle comprises a pivot bracket having a pivot shaft pivotally connected to said swing arm, and a grip rotatably mounted in said pivot bracket for rotation about a fourth pivot axis transverse to the third pivot axis.

34. The machine as claimed in claim 31, wherein each handle is located inboard of the respective swing arm facing said seat.

35. An exercise machine, comprising:

a support frame having a base, an upright portion extending upwardly from the base and having an upper end, and an upper support extending transversely from the upper end of the upright portion;

a seat supported on the frame;

a pair of exercise arm assemblies pivotally secured to the frame to extend on opposite sides of said seat;

each arm assembly having a main arm, a swing arm, and a handle;

each main arm having a first end pivoted to the frame for pivoting about a first pivot axis and a second end;

each swing arm having a pivot connection to the respective main arm which allows pivoting of the swing arm relative to the main arm about a second pivot axis;

each handle being pivoted to the respective swing arm for pivoting about a third pivot axis, each pivot axis being non-parallel to the other two pivot axes, and at least one pivot axis being non-perpendicular to the other two pivot axes;

the main arms being pivoted to the upper support and the swing arms depending downwardly from the upper support, each swing arm being pivoted to the respective main arm at a location spaced below the first end of the main arm;

each main arm having a first downward bend separating the main arm into a first portion extending from the first end to the first bend and a second portion inclined downwardly from the first portion, and the swing arm having a second bend separating the swing arm into a first portion extending from the main arm to the second bend, and a second portion directed inwardly from the second bend towards the other swing arm; and a pivot connection between each main arm and the frame defining a respective first pivot axis, said pivot connection including a range of motion device having a series of spaced holes extending along an arc, and each main arm having a connecting pin for releasably connecting said main arm to said range of motion device at any one of a series of selected orientations relative to said range of motion device.

36. An exercise machine, comprising:

a support frame having a base, an upright portion extending upwardly from the base and having an upper end, and an upper support extending transversely from the upper end of the upright portion;

a seat supported on the frame;

a pair of exercise arm assemblies pivotally secured to the frame which extend on opposite sides of said seat;

each arm assembly having a main arm, a swing arm, and a handle;

each main arm pivoted to the frame for pivoting about a first pivot axis;

each swing arm pivoted to the respective main arm for pivoting about a second pivot axis which is not coaxial with the swing arm;

each handle being pivoted to the respective swing arm for pivoting about a third pivot axis, each pivot axis being non-parallel to the other two pivot axes, and at least one pivot axis being non-perpendicular to the other two pivot axes; and a pivot connection in each arm assembly, each pivot connection comprising a pivot bracket secured to one of the arms and having a pair of spaced end plates projecting over the other arm, and a pivot pin extending between the end plates along said second pivot axis and rotatably linked to the other arm.

37. The machine as claimed in claim 36, wherein the pivot connection includes a range limiting device for limiting the swing of the swing arm about the second pivot axis to a predetermined angular range, the range limiting device being mounted between said end plates.

38. The machine as claimed in claim 37, wherein the pivot connection includes a sleeve secured to said other arm and rotatably engaged over said pivot pin, the range limiting device comprising a first part projecting from said sleeve in a direction transverse to said second pivot axis and having a notch defining said predetermined angular range, and a second part extending between said end plates and engaging transversely in said notch for travel along said notch as said swing arm rotates about said second pivot axis.

* * * * *